US011219250B1

(12) United States Patent
Martinangeli et al.

(10) Patent No.: US 11,219,250 B1
(45) Date of Patent: Jan. 11, 2022

(54) ARTICLE OF CLOTHING WITH TOOLS INCORPORATED THEREIN

(71) Applicants: Franco Martinangeli, Miami, FL (US); Luis Eduardo Real, Haleiwa, HI (US)

(72) Inventors: Franco Martinangeli, Miami, FL (US); Luis Eduardo Real, Haleiwa, HI (US)

(73) Assignee: Ascend Surf, LLC, Miami, FL (US)

( * ) Notice: Subject to any disclaimer, the term of this patent is extended or adjusted under 35 U.S.C. 154(b) by 109 days.

(21) Appl. No.: 16/568,373

(22) Filed: Sep. 12, 2019

(51) Int. Cl.
*A41D 7/00* (2006.01)
*B25B 15/00* (2006.01)

(52) U.S. Cl.
CPC ..... *A41D 7/005* (2013.01); *B25B 15/008* (2013.01); *A41D 2300/33* (2013.01)

(58) Field of Classification Search
CPC ... A41D 7/005; A41D 2300/33; B25B 15/008
USPC ..... 2/235, 69.5
See application file for complete search history.

(56) References Cited

U.S. PATENT DOCUMENTS 3,160,935 A * 12/1964 Broyles ..... A44B 13/0017 24/390
3,418,700 A * 12/1968 Edelman ..... A41F 1/006 24/578.1
4,807,362 A * 2/1989 Prentice ..... F41B 15/00 30/155
6,044,496 A * 4/2000 Ramirez ..... A41F 9/025 2/219
6,185,772 B1 * 2/2001 Bates ..... A44B 11/005 7/151
9,179,726 B2 * 11/2015 Hanover ..... F41C 33/048
9,259,039 B2 * 2/2016 Okies ..... A41F 9/02
2009/0031467 A1 * 2/2009 Swindells ..... A41D 13/0012 2/51
2012/0011638 A1 * 1/2012 Geary ..... A41F 1/00 2/336
2012/0170964 A1 * 7/2012 Bogdanoff ..... A45D 40/18 401/52
2013/0298311 A1 * 11/2013 Gerenda ..... A41F 9/025 2/235
2014/0047619 A1 * 2/2014 Singh ..... A41D 1/08 2/235

* cited by examiner

*Primary Examiner* — Alissa J Tompkins
*Assistant Examiner* — Catherine M Ferreira
(74) *Attorney, Agent, or Firm* — Albert Boras, P.A.

(57) ABSTRACT

An article of clothing with tools incorporated therein. The article of clothing has a strap assembly that has a strap body with first and second strap ends and at least one tool assembly. The at least one tool assembly is secured within the first and/or second strap ends. The at least one tool assembly is a fin key. The at least one tool assembly has a plate and a shaft. The plate is secured within the strap body while a respective shaft protrudes from a respective first or second aperture. The first and second apertures each have a predetermined size to secure the plate within the strap body while a respective shaft protrudes from the respective first or second ends. The strap assembly is incorporated onto an article of clothing such as a boardshort.

8 Claims, 3 Drawing Sheets

PRIOR ART

ARTICLE OF CLOTHING WITH TOOLS INCORPORATED THEREIN

I. BACKGROUND OF THE INVENTION

1. Field of the Invention

The present invention relates to clothing, and more particularly, to an article of clothing with tools incorporated therein.

2. Description of the Related Art

Applicant is not aware of any article of clothing with tools incorporated therein having the novel features of the present invention.

II. SUMMARY OF THE INVENTION

The present invention is an article of clothing with tools incorporated therein, comprising a strap assembly having a strap body with first and second strap ends and at least one tool assembly, wherein the at least one tool assembly is incorporated within the strap assembly.

The at least one tool assembly is secured within the first and/or second strap end. In a preferred embodiment, the at least one tool assembly is a fin key, a hex key, a wrench, a screwdriver, a key, or any other tool. The first and second strap ends comprise respective first and second apertures. The strap body comprises a first predetermined width. The first and second strap ends comprise second and third predetermined widths respectively, wherein the second and third predetermined widths are approximately the same. The first predetermined width is wider than the second and third predetermined widths.

The at least one tool assembly comprises a plate and a shaft. The shaft comprises a proximal end and a distal end, whereby the proximal end is adjacent to the plate. The plate comprises at least one hole. The at least one tool assembly is incorporated into the strap assembly, whereby the plate is secured within the strap body and the shaft protrudes from a respective first or second aperture. The at least one tool assembly is attached to the strap assembly. Each proximal end relatively aligns with the respective first and second strap ends. The plate is secured within the strap body with stitching through the at least one hole. The first and second apertures each have a predetermined size to secure the plate within the strap body while the shaft protrudes from the respective first or second end. The strap assembly is incorporated onto an article of clothing such as a boardshort.

It is therefore one of the main objects of the present invention to provide an article of clothing with tools incorporated therein.

It is another object of this invention to provide an article of clothing with tools incorporated therein, wherein the tool may be a fin key, a hex key, a wrench, a screwdriver, a key, or any other tool.

It is another object of this invention to provide an article of clothing with fin keys incorporated therein, wherein the fin keys are attached to the ends of a strap of a boardshort.

It is another object of this invention to provide an article of clothing with a fin key incorporated therein, which is of a durable and reliable construction.

It is yet another object of this invention to provide an article of clothing with tools incorporated therein that is inexpensive to manufacture and maintain while retaining its effectiveness.

Further objects of the invention will be brought out in the following part of the specification, wherein detailed description is for the purpose of fully disclosing the invention without placing limitations thereon.

III. BRIEF DESCRIPTION OF THE DRAWINGS

With the above and other related objects in view, the invention consists in the details of construction and combination of parts as will be more fully understood from the following description, when read in conjunction with the accompanying drawings in which.

IV. DETAILED DESCRIPTION OF THE PREFERRED EMBODIMENT

Figure 1:
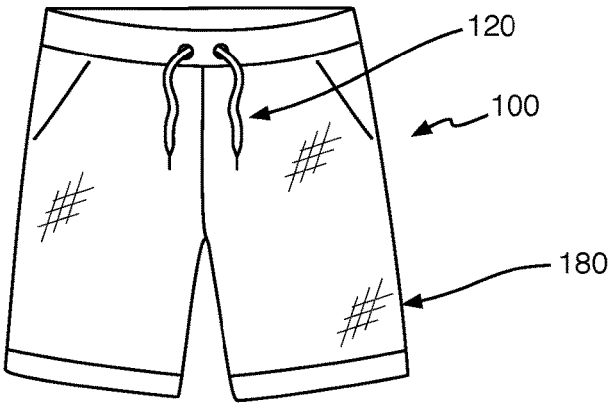
FIG. 1 is front view of a prior art article of clothing.

Referring now to the drawings, the present invention is an article of clothing with tools incorporated therein, and is generally referred to with numeral 10. It can be observed that it basically includes strap assembly 20 and at least one tool assembly 40.

As seen in FIG. 1, prior art article of clothing 100 is a boardshort and comprises article of clothing 180 having strap assembly 120. Boardshorts are a type of swimwear and casual wear in the form of relatively long, approximately knee length, loose-fitting shorts. Originally known as surf trunks, and occasionally in British English as swim shorts, boardshorts are a style of men's and women's summer wear. Boardshorts are designed to be quick-drying, and are generally made from strong and smooth polyester or nylon material. They are durable and hold up to wear from contact with a surfboard, yet are comfortable and light-weight. They are well-adapted to use in various active watersports. Boardshorts do not have an elastic waist like many swim shorts; instead they have a more rigid waistband, which opens at the front, often with a hook-and-loop type fastener as a fly. The waistband is also held together at the front with a lace-up tie, or strap assembly 120.

Figure 2:
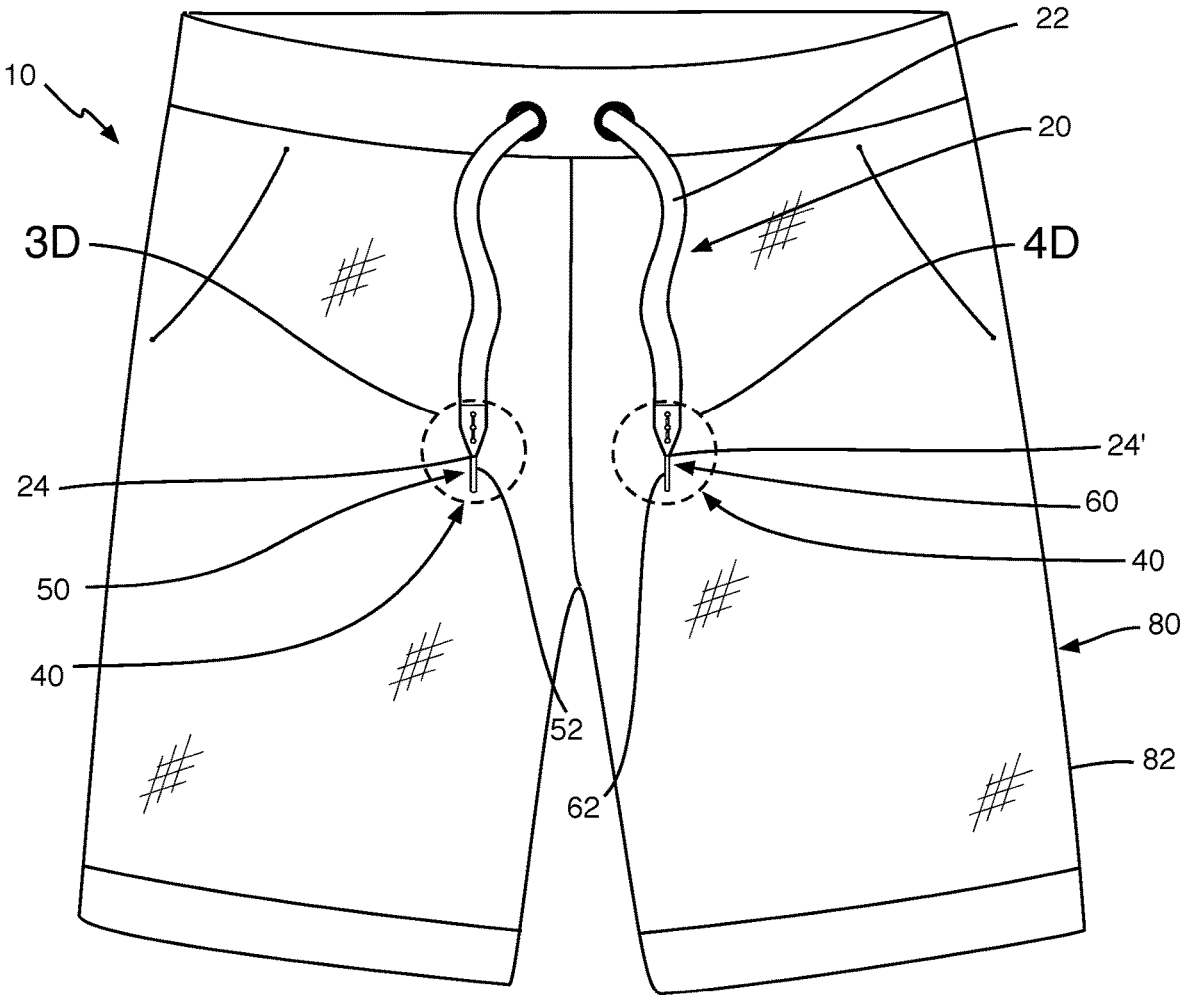
FIG. 2 is a front view of the present invention.

As seen in FIG. 2, strap assembly 20 comprises strap body 22 having first and second strap ends 24 and 24'. At least one tool assembly 40 is secured within strap assembly 20, and more specifically within first strap end 24 and/or second strap end 24'. In a preferred embodiment, strap assembly 20 comprises first and second tool assemblies 40 within respective first and second strap ends 24 and 24'. At least one tool assembly 40 is a tool such as, but is not limited to, a fin key, a hex key, a wrench, a screwdriver, a key, or any other tool.

In a preferred embodiment, first and second tool assemblies 40 are first and second fin keys 50 and 60. First and second fin keys 50 and 60 comprise shafts 52 and 62 respectively, protruding from respective first and second strap ends 24 and 24'. In a preferred embodiment, first shaft 52 is hexagonal in shape and has a first predetermined diameter, and second shaft 62 is also hexagonal in shape and has a second predetermined diameter. In the preferred embodiment, the first and second predetermined diameters are different, but it is noted that they may also be a same diameter.

Strap assembly 20 comprises at least one tool assembly 40 incorporated within article of clothing 80, wherein article of clothing 80 may be swim shorts, and specifically boardshort 82. In a preferred embodiment, boardshort 82 comprises strap assembly 20 having first and second fin keys 50 and 60 respectively.

Strap body 22 comprises a first predetermined width, and first and second strap ends 24 and 24' comprise second and third predetermined widths respectively, wherein the second and third predetermined widths are approximately the same. The first predetermined width is wider than the second and third predetermined widths.

Figure 3A:
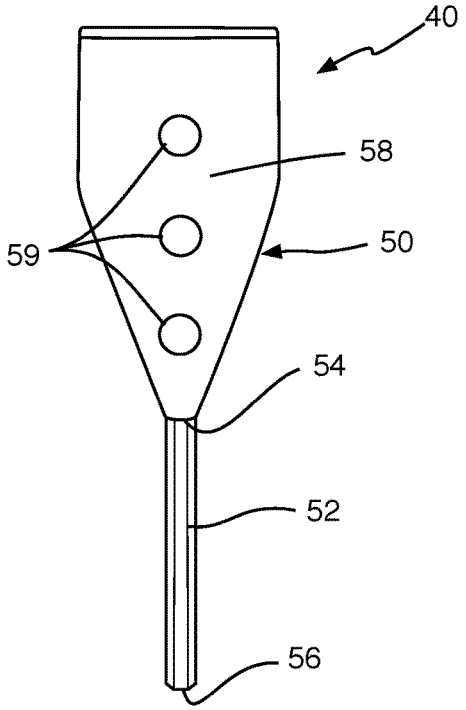
FIG. 3A is a front view of a first tool.
Figure 3B:
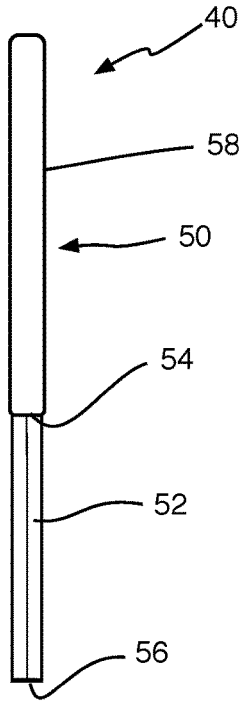
FIG. 3B is a lateral view of the first tool.
Figure 3C:
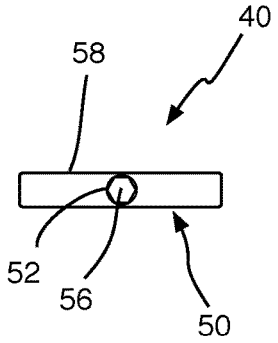
FIG. 3C is a bottom view of the first tool.

As seen in FIGS. 3A, 3B, and 3C, first tool assembly 40, defined as fin key 50, comprises shaft 52 and plate 58. Shaft 52 comprises proximal end 54 and distal end 56, whereby proximal end 54 is adjacent to plate 58. In a preferred embodiment, shaft 52 is hexagonal in shape. Plate 58 comprises at last one hole 59, and in a preferred embodiment, plate 58 comprises three holes 59.

Figure 3D:
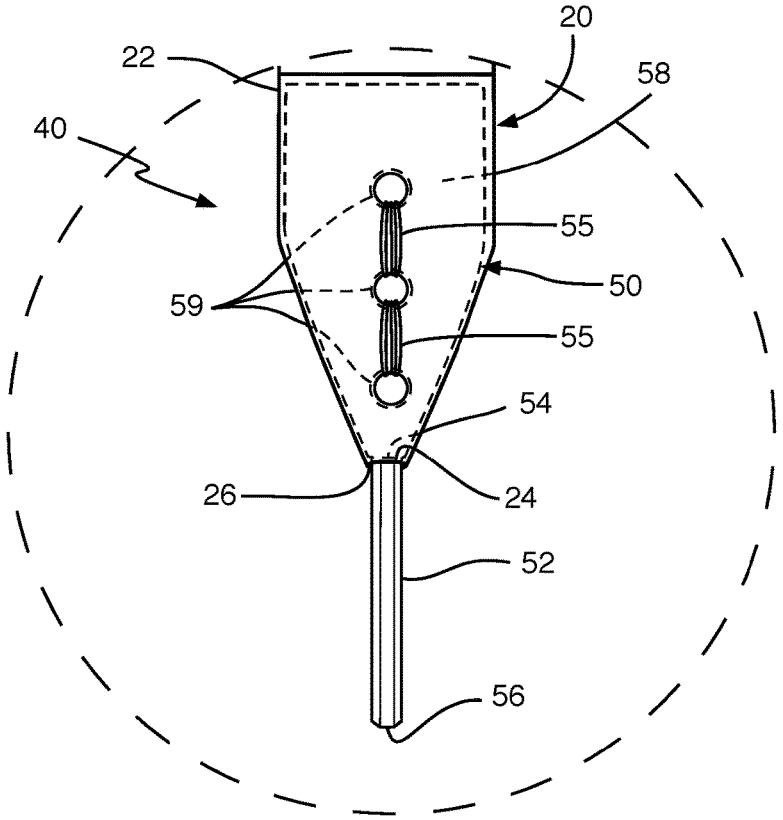
FIG. 3D is a close up of the first tool in section 3D as seen in FIG. 1.

As seen in FIG. 3D, fin key 50 is incorporated into strap assembly 20. In a preferred embodiment, fin key 50 is secured within first end 24, whereby plate 58 is secured inside body strap 22 while shaft 52 protrudes from first aperture 26. When fin key 50 is attached to strap assembly 20, proximal end 54 relatively aligns with strap end 24. First aperture 26 is of a predetermined size to secure plate 58 within strap body 22 while shaft 52 protrudes therefrom. In a preferred embodiment, plate 58 is fixed within strap body 22 with stitching 55 through holes 59.

Figure 4A:
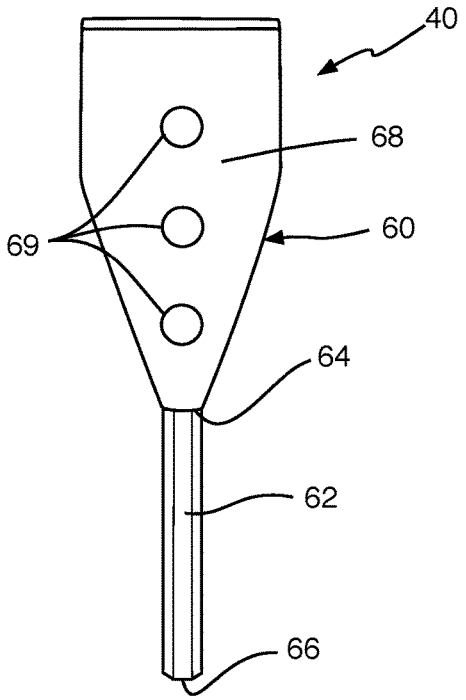
FIG. 4A is a front view of a second tool.
Figure 4B:
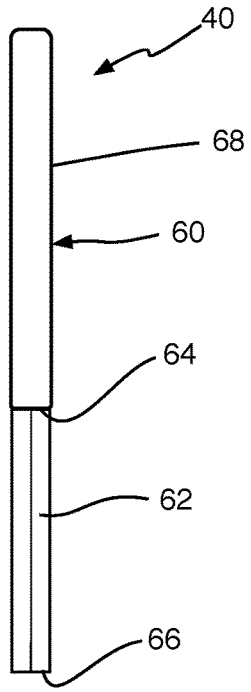
FIG. 4B is a lateral view of the second kind tool.
Figure 4C:
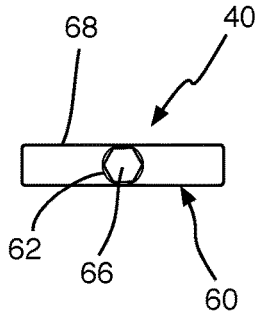
FIG. 4C is a bottom view of the second tool.

As seen in FIGS. 4A, 4B, and 4C, second tool assembly 40, defined as fin key 60, comprises shaft 62 and plate 68. Shaft 62 comprises proximal end 64 and distal end 66, whereby proximal end 64 is adjacent to plate 68. In a preferred embodiment, shaft 62 is hexagonal in shape. Plate 68 comprises at last one hole 69, and in a preferred embodiment, plate 68 comprises three holes 69.

Figure 4D:
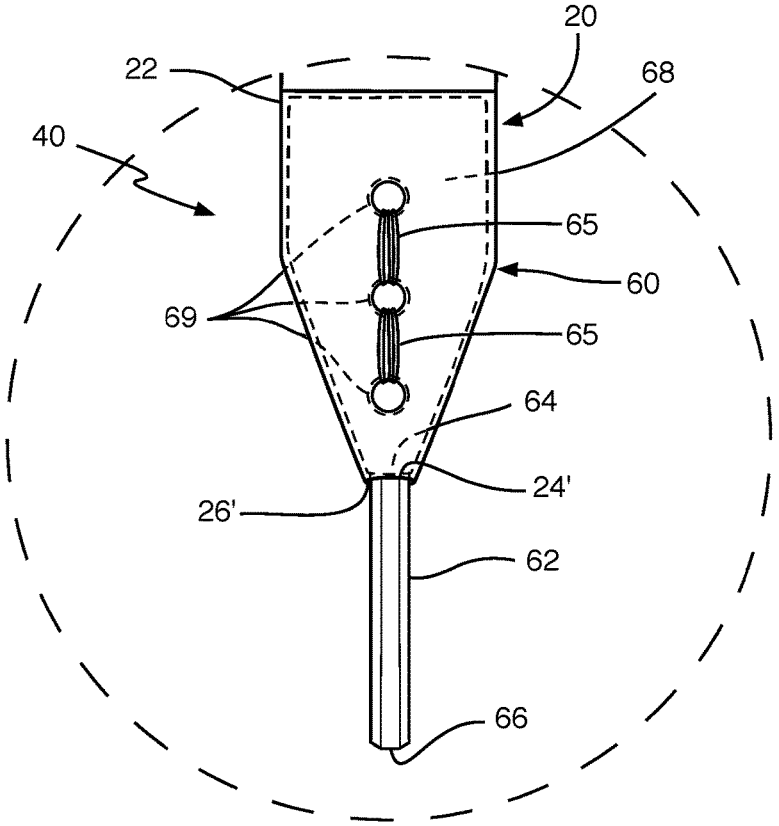
FIG. 4D is a close up of the second tool in section 4D as seen in FIG. 1.

As seen in FIG. 4D, fin key 60 is incorporated into strap assembly 20. In a preferred embodiment, fin key 60 is secured within strap end 24', whereby plate 68 is secured inside body strap 22 while shaft 62 protrudes from second aperture 26'. When fin key 60 is attached to strap assembly 20, proximal end 64 relatively aligns with strap end 24'. Second aperture 26' is of a predetermined size to secure plate 68 within strap body 22 while shaft 62 protrudes therefrom. In a preferred embodiment, plate 68 is fixed within strap body 22 with stitching 65 through holes 69.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An article of clothing with tools incorporated therein, comprising:

A) a strap assembly comprising a strap body having first and second strap ends; and B) at least one tool assembly, wherein said at least one tool assembly is embedded within said strap assembly, said at least one tool assembly is a fin key that is secured within said first or second strap end, said first and second strap ends comprise respective first and second apertures, said fin key comprises a plate and a shaft, said shaft comprises a proximal end and a distal end, whereby said proximal end is adjacent to said plate, said plate comprises at least one hole, said fin key is embedded into said strap assembly, whereby said plate is secured within said strap body and said shaft protrudes from said respective first or second aperture.

2. The article of clothing with tools incorporated therein set forth in claim 1, further characterized in that said strap body comprises a first predetermined width.

3. The article of clothing with tools incorporated therein set forth in claim 2, further characterized in that said first and second strap ends comprise second and third predetermined widths respectively, wherein said second and third predetermined widths are approximately the same.

4. The article of clothing with tools incorporated therein set forth in claim 3, further characterized in that said first predetermined width is wider than said second and third predetermined widths.

5. The article of clothing with tools incorporated therein set forth in claim 1, further characterized in that when said at least one tool assembly is attached to said strap assembly, said proximal end relatively aligns with a respective said first or second strap end.

6. The article of clothing with tools incorporated therein set forth in claim 1, further characterized in that said plate is secured within said strap body with stitching through said at least one hole.

7. The article of clothing with tools incorporated therein set forth in claim 1, further characterized in that said first and second apertures each have a predetermined size to secure said plate within said strap body while said shaft protrudes from said respective first or second end.

8. The article of clothing with tools incorporated therein set forth in claim 1, further characterized in that said article of clothing is a boardshort.

* * * * *